US010605546B2

(12) United States Patent
Yajima et al.

(10) Patent No.: US 10,605,546 B2
(45) Date of Patent: Mar. 31, 2020

(54) HEAT EXCHANGER

(71) Applicants: Tokyo Electric Power Company Holdings Inc., Tokyo (JP); Tamagawa University and Tamagawa Academy, Tokyo (JP)

(72) Inventors: Takeshi Yajima, Tokyo (JP); Hidetoshi Ohkubo, Tokyo (JP)

(73) Assignees: TOKYO ELECTRIC POWER COMPANY HOLDINGS, INC., Tokyo (JP); TAMAGAWA UNIVERSITY AND TAMAGAWA ACADEMY, Tokyo (JP)

( * ) Notice: Subject to any disclaimer, the term of this patent is extended or adjusted under 35 U.S.C. 154(b) by 34 days.

(21) Appl. No.: 15/793,517

(22) Filed: Oct. 25, 2017

(65) Prior Publication Data

US 2018/0142969 A1 May 24, 2018

(30) Foreign Application Priority Data

Nov. 22, 2016 (JP) ..... 2016-226693

(51) Int. Cl.
*F28F 17/00* (2006.01)
*F28F 1/02* (2006.01)
(Continued)

(52) U.S. Cl.
CPC ..... *F28F 17/005* (2013.01); *F24F 11/41* (2018.01); *F24F 13/30* (2013.01); *F25D 21/04* (2013.01);
(Continued)

(58) Field of Classification Search
CPC .. F28F 17/005; F28F 1/022; F28F 1/16; F28F 1/32; F28F 3/025; F28F 21/084; F28F 2215/12; F28F 13/10; F28F 2245/08; F28F 19/008; F28F 5/00; F28F 2215/10; F28F 13/14; F24F 11/41; F24F 13/30; F24F 1/0059; F25D 21/04; F25D 21/065; F25D 21/14; F28G 1/02; F28G 7/00; F26B 11/00; F28D 11/00; F28D 15/0208
(Continued)

(56) References Cited

U.S. PATENT DOCUMENTS 3,145,456 A * 8/1964 Johnson ..... B21D 53/045 165/183
3,645,330 A * 2/1972 Albright ..... F28F 1/32 165/151
(Continued)

FOREIGN PATENT DOCUMENTS

JP 2009-109063 5/2009
JP 2012-082989 4/2012
JP 2012082989 A * 4/2012

*Primary Examiner* — Justin M Jonaitis
(74) *Attorney, Agent, or Firm* — Venkatesh Krishnamoorthy; Silicon Valley Patent Group, LLP

(57) ABSTRACT

This disclosure provides a heat exchanger that can more efficiently remove the frost attached to the heat exchanger. A configuration of a heat exchanger according to the present invention includes a heat transfer member (e.g., a fin) that performs heat exchange with air, wherein the heat transfer member (e.g., the fin) includes, in a vicinity of an upstream-side edge in an air traveling direction, a plurality of linear protruding portions that are formed in parallel to the edge.

8 Claims, 14 Drawing Sheets

(51) Int. Cl.

| | |
|---|---|
| ***F28F 1/16*** | (2006.01) |
| ***F28G 1/02*** | (2006.01) |
| ***F24F 11/41*** | (2018.01) |
| ***F24F 13/30*** | (2006.01) |
| ***F25D 21/04*** | (2006.01) |
| ***F25D 21/06*** | (2006.01) |
| ***F28F 1/32*** | (2006.01) |
| ***F28F 3/02*** | (2006.01) |
| ***F28F 21/08*** | (2006.01) |
| ***F24F 1/0059*** | (2019.01) |
| ***F25D 21/14*** | (2006.01) |

(52) U.S. Cl.
CPC ..... *F25D 21/065* (2013.01); *F28F 1/022* (2013.01); *F28F 1/16* (2013.01); *F28F 1/32* (2013.01); *F28F 3/025* (2013.01); *F28F 21/084* (2013.01); *F28G 1/02* (2013.01); *F24F 1/0059* (2013.01); *F25D 21/14* (2013.01); *F28F 2215/12* (2013.01)

(58) Field of Classification Search
USPC ..... 165/231, 91–92, 94, 95, 86
See application file for complete search history.

(56) References Cited

U.S. PATENT DOCUMENTS

| | | | | | |
|---|---|---|---|---|---|
| 4,300,629 | A * | 11/1981 | Hatada | F28F 1/325 | 165/151 |
| 4,645,119 | A * | 2/1987 | Haramaki | B23K 1/0012 | 148/24 |
| 5,168,923 | A * | 12/1992 | Sacks | B21D 53/04 | 165/151 |
| 5,660,230 | A * | 8/1997 | Obosu | F28F 1/325 | 165/151 |
| 5,752,567 | A * | 5/1998 | Obosu | F28F 1/325 | 165/151 |
| 5,896,920 | A * | 4/1999 | Jun | F28F 1/325 | 165/146 |
| 2004/0261986 | A1* | 12/2004 | Insalaco | F28F 1/022 | 165/181 |
| 2005/0056407 | A1* | 3/2005 | Oh | F28F 1/32 | 165/151 |
| 2016/0327348 | A1* | 11/2016 | Yabe | F28D 1/05383 | |

* cited by examiner

| | | Working Example | | | | | | Comparative Example | | | | | |
|---|---|---|---|---|---|---|---|---|---|---|---|---|---|
| Elapsed Time | min | 7 | 15 | 30 | 45 | 60 | 75 | 7 | 15 | 30 | 45 | 60 | 75 |
| Heat Transfer Coefficient | W/m2·K | 26.9 | 26.8 | 27.5 | 27.2 | 22.9 | 15.9 | 16.8 | 14.4 | 15.7 | 14.0 | 13.9 | 12.4 |
| Pressure Loss | Pa | 15 | 16 | 19 | 23 | 28 | 30 | 18 | 19 | 21 | 25 | 31 | 34 |

| | W [μm] Width of Flat Surface Portions | L [μm] Spacing between Flat Surface Portions | Z [μm] Height of Protruding Portions |
|---|---|---|---|
| Working Example 1 | 100 | 250 | a~e |
| Working Example 2 | 250 | 250 | a~e |
| Working Example 3 | 500 | 250 | a~e |
| Working Example 4 | 250 | 500 | 700 |
| Working Example 5 | 250 | 750 | 700 |
| Working Example 6 | 250 | 1000 | 700 |
| Comparative Example | – | – | – |

| Sub-Number | Z [μm] Height of Protruding Portions |
|---|---|
| a | 300 |
| b | 400 |
| c | 500 |
| d | 600 |
| e | 700 |

Width of Flat Surface Portions (W)

Spacing between Flat Surface Portions (L)

Height of Protruding portions (Z)

Working Example7

| | |
|---|---|
| Initial Cooling Surface Temperature | $t_{w0} = -190°C$ |
| Air Temperature | $t_a = 25°C$ |
| Cooling Surface Orientation | $\Theta = 90°$ |
| Air Humidity | $x_a = 0.0119 kg/kg$ |

HEAT EXCHANGER

CROSS-REFERENCE TO RELATED APPLICATIONS

This application claims priority to Japanese Patent Application No.: JP2016-226693 entitled "HEAT EXCHANGER," and filed Nov. 22, 2016, which is assigned to the assignee hereof and incorporated herein by reference in its entirety.

FIELD

This disclosure relates generally to a heat exchanger including a heat transfer member that performs heat exchange with air.

BACKGROUND

Conventionally, heat pump air conditioners and freezers that perform heat exchange with air are provided. A heat pump for use in, for example, an air conditioner, absorbs heat from cold air during winter, and thus its heat exchanger is frosted. In the case of a heat pump for use in a freezer, its heat exchanger is cooled to a temperature below the freezing point in order to generate an intended low temperature, as a result of which the heat exchanger is frosted. The frost layer has a low thermal conductivity and thus serves as a heat insulator, causing a reduction in the operational efficiency of the heat pump. For this reason, when frost is formed, it is necessary to remove the frost.

In a conventional heat pump, a defrost operation is performed such that upon detection of the degree of frosting based on the refrigerant pressure or the like, the operation is temporarily stopped so as to reverse the refrigeration cycle to perform thawing with hot gas. Alternatively, there is a conventional heat pump in which its evaporator is caused to function as a condenser by counter-rotating the refrigerant so as to perform thawing. Patent Document 1 discloses a refrigeration cycle apparatus that performs a defrost operation by switching a direction of flow of the refrigerant such that the function of the heat exchanger is reversed by a four-way switching valve.

However, in the case where the refrigerant is counter-rotated during a defrost operation of the heat pump as in Patent Document 1, it is necessary to intermittently stop its heat exchange operation, and thus a problem arises in that the heat pump cannot be operated continuously. Also, because it is not possible to absorb heat for use to perform defrosting from the other side of the heat exchange operation (for example, it is not possible to absorb heat of indoor air by performing a defrost operation during heating operation), the amount of heat for defrosting is dependent exclusively on the pump work. At this time, the COP (coefficient of performance) is 1, and thus it is a cause of reduction of the COP of the heat pump as a whole.

Frosting is of significant value in terms of acquiring heat of solidification although it is problematic in that it causes a reduction in thermal conductivity. During heating, a heat pump uses, in addition to the sensible heat of air and moisture, the heat of condensation and heat of solidification (both of which are latent heat) of moisture. A test conducted by the present inventors revealed that the latent heat accounts for up to 40% of the total amount of heat exchanged (0 to 40% at a relative humidity of 50 to 80%).

From this, a situation is conceivable in which if frosting does not occur at all, the heat obtained from the heat pump also becomes insufficient. Accordingly, if defrosting can be performed mechanically (physically) instead of thawing the frost by heat, it may be possible to utilize heat of solidification to the maximum extent possible without causing an energy loss. However, as widely known, the crystals of solidified ice are hard, and it is not easy to remove the crystals mechanically.

In view of the above, the present inventors developed a heat exchanger that can mechanically remove the frost formed on the heat exchanger with ease (Patent Document 2). In the heat exchanger according to Patent Document 2, very fine protruding portions and recess portions are formed on the surface of a fin used in the heat exchanger. With this configuration, frost crystals grow vertically on the flat surface portions on top of the protruding portions, which creates gaps in the recessed portions. As a result, frost crystals having a comb-like shape as a whole are formed on the fin. The frost crystals having such a shape are structurally weak, and thus can be easily removed by mechanical removal means using a brush, a scraper, or the like. Therefore, according to Patent Document 2, the heat exchanger can operate continuously for a long period of time while utilizing heat of solidification.

SUMMARY OF THE DISCLOSURE

See related Patent Document 1 (JP 2009-109063A) and Patent Document 2 (Japanese Patent No. 5989961).

With the configuration of Patent Document 2, as described above, frost crystals having a comb-like shape as a whole are formed on the fin. Accordingly, the frost crystals formed in the vicinity of the outer periphery of the fin can be easily removed by using a brush or the like, but the frost crystals formed in the inside region that is out of the reach of a brush or the like are left. Therefore, there still is room for further improvement in removal of frost crystals in a more efficient way.

In view of the problem described above, it is an object of the present invention to provide a heat exchanger that can more efficiently remove the frost attached to the heat exchanger.

In order to solve the problem described above, a representative configuration of a heat exchanger according to the present invention is a heat exchanger including a heat transfer member that performs heat exchange with air, wherein the heat transfer member includes, in a vicinity of an edge thereof, the edge being located on an upstream side in an air traveling direction, a plurality of linear protruding portions formed in parallel to the edge.

With the configuration described above, in the heat transfer member of the heat exchanger, the linear protruding portions are formed on the upstream-side edge that is located on the upstream side in the air traveling direction. With this configuration, when air passes through the heat exchanger, the moisture in the air turns into frost crystals and vertically grows on the linear protruding portions. The frost crystals having such a shape is structurally weak, and thus can be easily removed by mechanical removal means.

At this time, because the linear protruding portions are provided in the vicinity of the upstream-side edge of the heat transfer member as described above, frost crystals are formed in the vicinity of the upstream-side edge, rather than the entire heat transfer member. That is, frost crystals are formed in a range within the reach of the brush or the like. Accordingly, it is possible to efficiently remove the frost attached to the heat transfer member by using a brush or the like.

The heat transfer member may be a fin, and the plurality of linear protruding portions may be formed in the vicinity of the edge that is located on the upstream side in the air traveling direction of the fin so as to be parallel to the edge. With this configuration, when the heat transfer member is a fin, by forming a plurality of linear protruding portions in the vicinity of its upstream-side edge, the above-described effects can be appropriately obtained.

The heat transfer member may be a finless tube, and the plurality of linear protruding portions may be formed on at least a surface of the finless tube that is located on the upstream side in the air traveling direction so as to extend vertically. With this configuration, even in a heat exchanger including a finless tube instead of a fin, by forming protruding portions on the upstream-side surface, the same effects as those described above can be obtained.

The protruding portions may also be formed in a vicinity of an edge of the heat transfer member, the edge being located on a downstream side in the air traveling direction. With this configuration, even on the downstream side of the fin, the moisture in the air is crystallized on the protruding portions. With this configuration, the moisture that was not crystallized on the upstream side can be crystallized on the downstream-side protruding portions, and it is therefore possible to more efficiently absorb heat of solidification from the air.

A greater number of the protruding portions may be provided on the upstream side of the heat transfer member than on the downstream side of the same. By providing more protruding portions on the upstream side where a large proportion of moisture in the air is crystallized, it is possible to facilitate crystallization of moisture and efficiently absorb heat of solidification. On the downstream side, the moisture remaining in the air that has passed through the upstream side is further crystallized.

The heat exchanger may further include a downstream heat transfer member that is disposed on a downstream side of the heat transfer member so as to be spaced apart from the heat transfer member. It is thereby possible to more efficiently perform heat exchange with air.

The plurality of protruding portions may be disposed so as to be spaced apart relative to each other in the air traveling direction, the plurality of protruding portions may include flat surface portions having a width of 100 μm or more and 500 μm or less on top of the protruding portions, a spacing between the flat surface portions of the protruding portions may be 100 μm or more and 1000 μm or less, and the protruding portions may have a height of 50 μm or more.

With this configuration, as a result of the flat surface portions being provided on top of the protruding portions, it is possible to facilitate the growth of frost crystals on top of the protruding portions in the normal direction. The flat surface portions preferably have a width of 100 μm or more, which is larger than the size of supercooled liquid droplets, and preferably 500 μm or less considering the rigidity for mechanical removal. Also, in order to suppress formation of frost between adjacent protruding portions, the spacing between the flat surface portions of the protruding portions is preferably 1000 μm or less. In order to suppress bonding of frost crystals on the protruding portions to each other, the spacing between the flat surface portions of the protruding portions is preferably 100 μm or more.

Furthermore, it is preferable that the protruding portions have a height of 50 μm or more. That is, the height of the protruding portions matches the depth of the spaces (hereinafter referred to as "recess portions") between the plurality of protruding portions. The recess portions less contribute to heat transfer, and thus play a significant role in disruption of frost crystals. In order to suppress formation of frost in the recess portions, the height of the protruding portions is preferably 50 μm or more.

The heat exchanger may further include a brush that is provided to abut the protruding portions and is vertically movable. With this configuration, it is possible to appropriately remove the frost attached to the protruding portions of the heat transfer member such as a fin and a finless tube.

The brush may be moved from top to bottom and moved back to the top. With this configuration, when the brush is moved from top to bottom, the frost separated from the heat transfer member drops downward. Accordingly, it is possible to prevent the removed frost from being scattered to the periphery and efficiently collect the frost. Also, a standby position for the brush is set to a top portion of the fin, and thus the brush does not absorb water from the frost drip pan.

The brush may have a fan shape in which bristles expand vertically toward a bristle tip thereof as viewed in a vertical cross section. With this configuration, irrespective of whether the brush is moved downward or upward, frost can be appropriately removed without forcing the frost deep into the fin.

According to the present invention, it is possible to provide a heat exchanger that can more efficiently remove the frost attached to the heat exchanger.

Disclosed is an apparatus and method in a heat exchanger. According to some aspects, disclosed is a heat exchanger comprising a heat transfer member that performs heat exchange with air, wherein the heat transfer member includes, in a vicinity of an edge thereof, the edge being located on an upstream side in an air traveling direction, a plurality of linear protruding portions formed in parallel to the edge.

According to some aspects, disclosed is a heat exchanger wherein the heat transfer member is a fin, and wherein the plurality of linear protruding portions are formed in the vicinity of the edge that is located on the upstream side in the air traveling direction of the fin so as to be parallel to the edge.

According to some aspects, disclosed is a heat exchanger wherein the heat transfer member is a finless tube, and wherein the plurality of linear protruding portions are formed on at least a surface of the finless tube that is located on the upstream side in the air traveling direction so as to extend vertically.

According to some aspects, disclosed is a heat exchanger wherein the protruding portions are also formed in a vicinity of an edge of the heat transfer member, the edge being located on a downstream side in the air traveling direction.

According to some aspects, disclosed is a heat exchanger wherein a greater number of the protruding portions are provided on the upstream side of the heat transfer member than on the downstream side of the same.

According to some aspects, disclosed is a heat exchanger further comprising a downstream heat transfer member that is disposed on a downstream side of the heat transfer member so as to be spaced apart from the heat transfer member.

According to some aspects, disclosed is a heat exchanger wherein the plurality of protruding portions are disposed so as to be spaced apart with each other in the air traveling direction, wherein the plurality of protruding portions include flat surface portions having a width of 100 μm or more and 500 μm or less on top of the protruding portions, wherein a spacing between the flat surface portions of the protruding portions is 100 μm or more and 1000 μm or less, and wherein the protruding portions have a height of 50 μm or more.

According to some aspects, disclosed is a heat exchanger further comprising a brush that is provided to abut the protruding portions and is vertically movable.

According to some aspects, disclosed is a heat exchanger wherein the brush is moved from top to bottom and moved back to the top.

According to some aspects, disclosed is a heat exchanger wherein the brush has a fan shape in which bristles expand vertically toward a bristle tip thereof as viewed in a vertical cross section.

It is understood that other aspects will become readily apparent to those skilled in the art from the following detailed description, wherein it is shown and described various aspects by way of illustration. The drawings and detailed description are to be regarded as illustrative in nature and not as restrictive.

DETAILED DESCRIPTION

Figure 1:
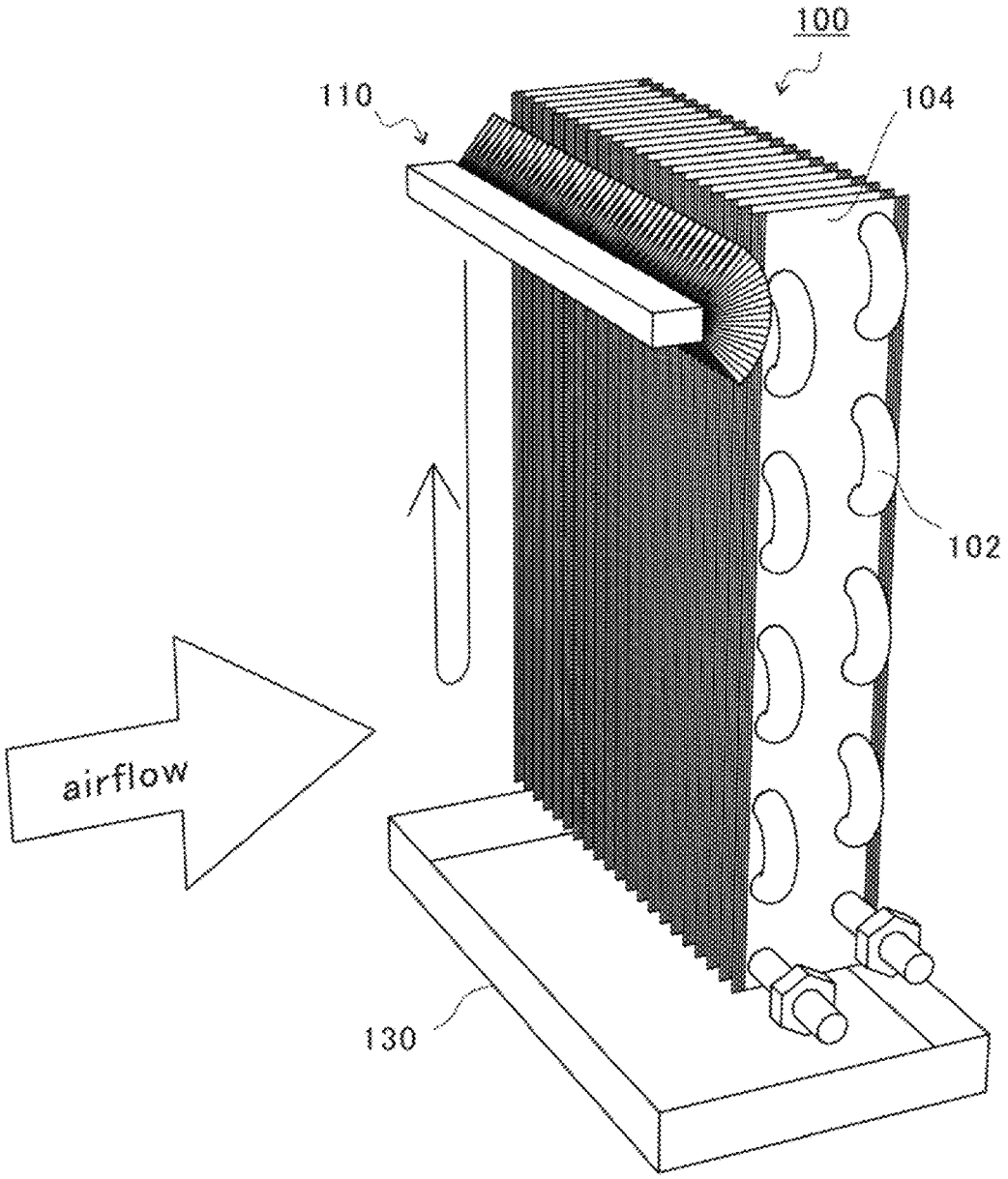
FIG. 1 is a diagram illustrating a configuration of a heat exchanger according to a first embodiment.

The detailed description set forth below in connection with the appended drawings is intended as a description of various aspects of the present disclosure and is not intended to represent the only aspects in which the present disclosure may be practiced. Each aspect described in this disclosure is provided merely as an example or illustration of the present disclosure, and should not necessarily be construed as preferred or advantageous over other aspects. The detailed description includes specific details for the purpose of providing a thorough understanding of the present disclosure. However, it will be apparent to those skilled in the art that the present disclosure may be practiced without these specific details. In some instances, well-known structures and devices are shown in block diagram form in order to avoid obscuring the concepts of the present disclosure. Acronyms and other descriptive terminology may be used merely for convenience and clarity and are not intended to limit the scope of the disclosure.

Hereinafter, preferred embodiments of the present invention will be described in detail with reference to the accompanying drawings. The dimensions, materials, specific numerical values, and the like shown in the following embodiments are merely examples for facilitating the understanding of the present invention, and therefore are not intended to limit the scope of the present invention unless otherwise stated. In the present specification and the drawings, constituent elements that substantially have the same functions and configurations are given the same reference numerals, and a redundant description will be omitted. In addition, constituent elements that are not directly related to the present invention are not illustrated in the drawings.

FIG. 1 is a diagram illustrating a configuration of a heat exchanger according to a first embodiment. A heat exchanger 100 is a finned tube heat exchanger that performs heat exchange with air (outside air) and through which a flow of air passes by a fan or the like (not shown). In a tube 102, a refrigerant is circulating through a pump, a condenser, and an expansion valve that are not shown in the diagrams. The heat exchanger 100 according to the first embodiment includes a fin 104 as a heat transfer member that performs heat exchange with air. The fin 104 is made of a metal having a high thermal conductivity such as copper or aluminum, and is expansion joined to the tube 102 so as to increase the surface area and thereby increase the thermal conductivity with air.

Figure 2:
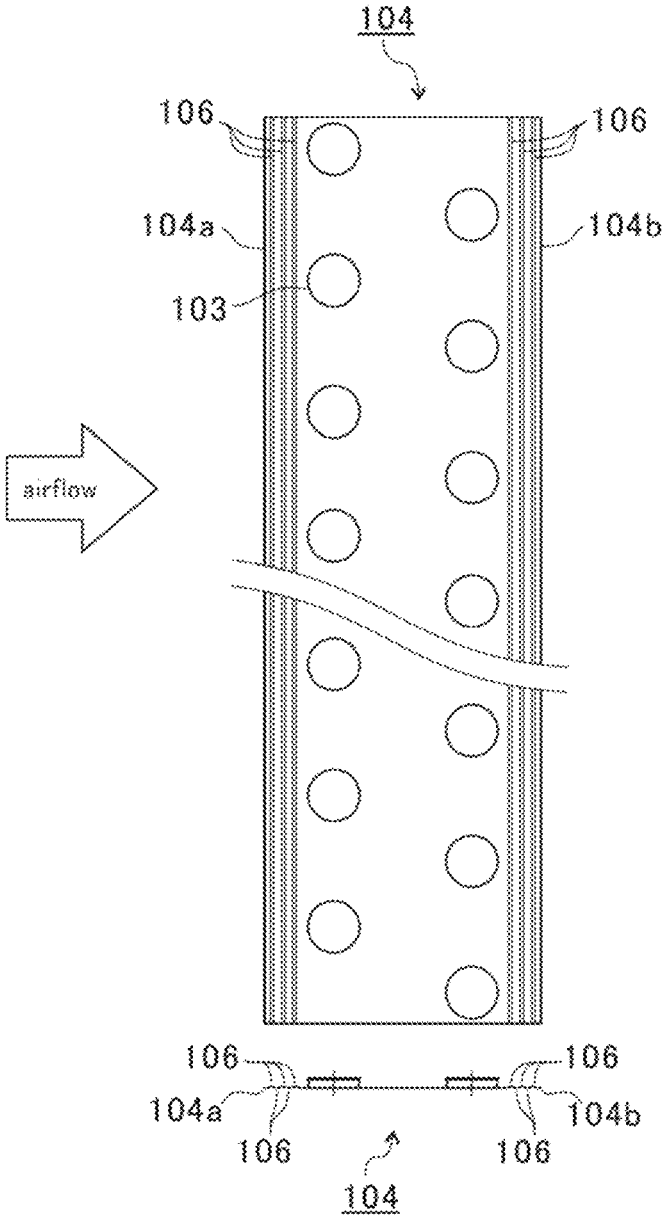
FIG. 2 is a plan view of a fin shown in FIG. 1.

FIG. 2 is a plan view of the fin 104 shown in FIG. 1. As shown in FIG. 2, as a feature of the heat exchanger 100 according to the first embodiment, in the fin 104 that is an example of the heat transfer member, in the vicinity of an edge 104*a* that is on an upstream side in an air traveling direction, a plurality of linear protruding portions 106 are formed in parallel to the edge 104*a*. The protruding portions 106 extend linearly in a vertical direction in parallel to the upstream-side edge 104*a* of the fin 104. The protruding portions 106 can be formed appropriately by pressing. In a region inside the edges of the fin 104, insertion holes 103 through which the tube 102 described above passes are formed.

Figure 3:
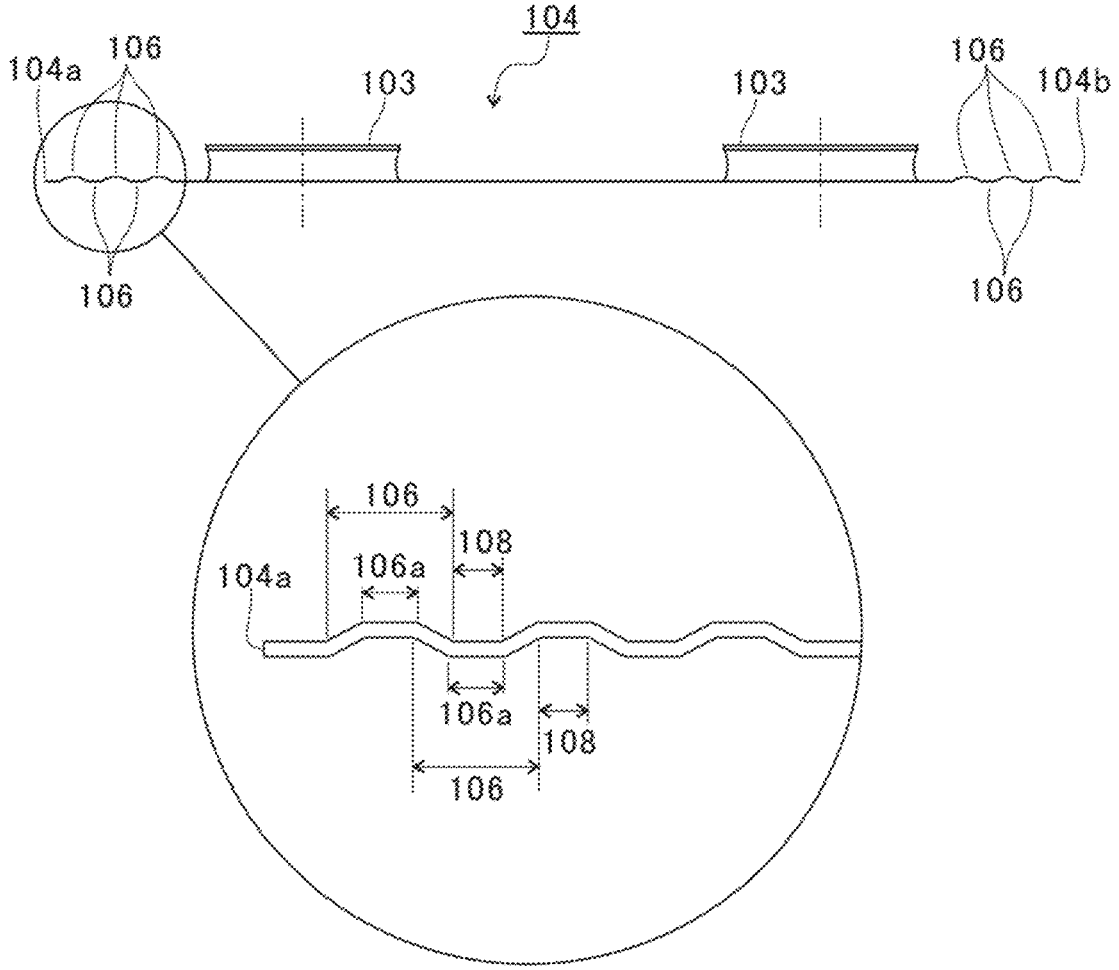
FIG. 3 is a cross-sectional view of the fin shown in FIG. 1.

FIG. 3 is a cross-sectional view of the fin 104 shown in FIG. 1. As shown in FIG. 3, in the heat exchanger 100 according to the present embodiment, a plurality of protruding portions 106 are disposed so as to be spaced apart from each other in the air traveling direction. With this configuration, as shown in an enlarged view in FIG. 3, recess portions 108 are formed between the plurality of protruding portions 106. Because the fin 104 is a thin plate, the recess portions 108 form protruding portions 106 on the opposite surface. That is, in the present embodiment, in the vicinity of the upstream-side edge 104*a* of the fin 104, a very fine corrugated shape composed of the protruding portions 106 and the recess portions 108 that are formed therebetween is formed. Flat surface portions 106*a* are formed on top of the protruding portions 106.

Figure 4:
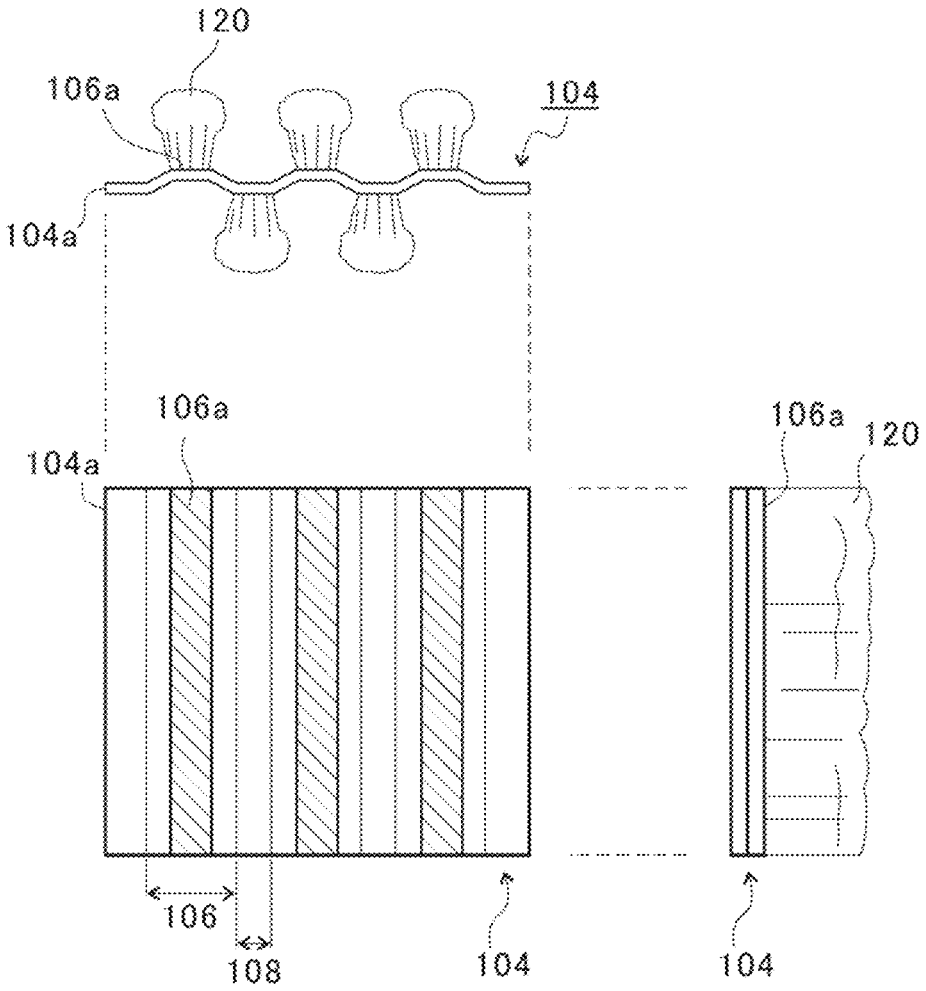
FIG. 4 is a three-view diagram of protruding portions and recess portions, in which a state of frost crystals is schematically shown.

FIG. 4 is a three-view diagram of the protruding portions 106 and the recess portions 108, in which a state of frost crystals 120 is schematically shown. Because the protruding portions 106 and the recess portions 108 as described above are formed, frost is attached exclusively to the flat surface portions 106*a* that are on top of the protruding portions 106, and crystals grow in a normal direction of the flat surface portions 106*a*. Accordingly, as shown in FIG. 4, frost crystals 120 are formed in a structure in which thin sheets in the form of ribs extending from the protruding portions 106 are arranged. If the protruding portions 106 have rounded top surfaces, frost crystals 120 grow radially. Accordingly, in order to cause frost crystals 120 to grow upward (to grow to form into thin sheets), it is important to form the flat surface portions 106*a* on top of the protruding portions 106.

The mechanism (reason) for formation of frost crystals 120 in the manner as described above remains, for the most part, still unexplained. To explain it inferentially, the moisture in the air turns into supercooled liquid droplets near the fin 104 and adheres to the flat surface portions 106*a* of the protruding portions 106. When the supercooled state is released, ice crystals start growing within the droplets (become crystallized in air at a temperature as low as about −40 degrees or less). Then, when additional supercooled liquid droplets adhere to the formed crystals, the ice crystals grow epitaxially thereon, forming new crystals growing continuously from the existing crystal structures. As a result, frost crystals 120 having the same crystal orientation are formed and grow in the normal direction of the flat surface portions 106*a*.

The reason that the top surfaces of the protruding portions 106 are frosted, but the inside portions of the recess portions 108 are not frosted is presumably because air dries as a result of supercooled liquid droplets adhering to the top surfaces of the protruding portions 106, and thus moisture hardly reaches the inside portions of the recess portions 108.

The frost crystals 120 formed in the manner as described above are thin sheets, and thus are structurally weak and easily broken from the interface with the protruding portions 106. Accordingly, the frost crystals 120 can be easily removed by mechanical removal means such as a brush. For this reason, as shown in FIG. 1, the heat exchanger 100 according to the present embodiment includes a brush 110. The brush 110 is disposed so as to abut the protruding portions 106 of the fin 104, and is vertically movable.

At this time, in the heat exchanger 100 according to the first embodiment, in particular, the protruding portions 106 and the recess portions 108 described above are formed in the vicinity of the upstream-side edge 104*a* instead of the entire surface of the fin 104. For this reason, frost crystals 120 are formed only in the vicinity of the upstream-side edge 104*a* rather than the entire fin 104. Accordingly, by vertically moving the brush 110 disposed so as to be in contact with the protruding portions 106, the frost crystals 120 attached to the upstream-side edge 104*a* of the fin 104 can be appropriately removed. In other words, the upstream-side edge 104*a* of the fin 104 is a region that is within the reach of the brush 110. Because frost crystals 120 are formed only in that region, the frost crystals 120 can be removed by simply moving the brush 110 in the vertical direction.

Figure 5:
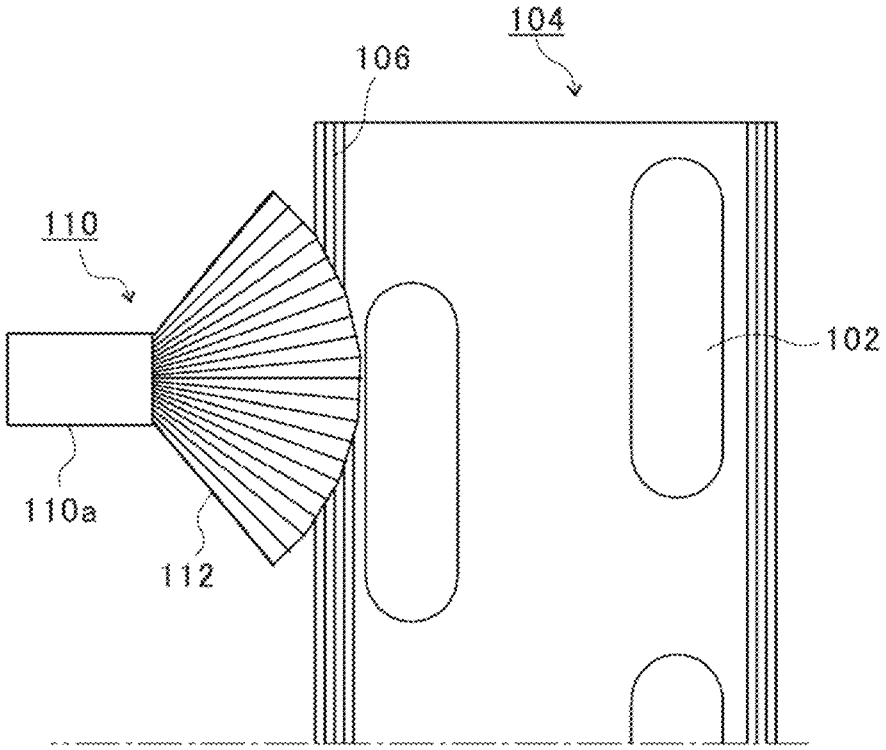
FIG. 5 is a diagram illustrating a brush serving as mechanical removal means.

FIG. 5 is a diagram illustrating the brush 110 serving as mechanical removal means. As shown in FIG. 5 the brush 110 according to the present embodiment includes bristles 112 attached to a shaft 110*a*, and has a fan shape in which the bristles 112 expand vertically toward its bristle tip as viewed in a vertical cross section.

If a conventional brush that does not expand toward its bristle tip is used, when the brush is moved downward, the bristle tip is entirely bent upward, which may cause removed frost crystals 120 to be forced deep into the fin 104. On the other hand, when the brush is moved upward, the bristle tip is entirely bent downward, which may also cause removed frost crystals 120 to be forced deep into the fin 104.

In contrast, according to the present embodiment, the brush 110 has a fan shape in which the bristles expand vertically toward its bristle tip. When the brush is moved downward, the frost crystals 120 are removed by the bristle tip that is moved downward. When the brush is moved upward, the frost crystals 120 are removed by the bristle tip that is moved upward. Accordingly, irrespective of whether the brush 110 is moved upward or downward, the frost crystals 120 can be efficiently removed without forcing the removed frost crystals 120 deep into the fin 104.

It is preferable that a standby position for the brush 110 is set to a top portion of the fin 104. When removing the frost crystals 120, the brush 110 is preferably moved from top to bottom and then moved back from bottom to top. At the time of reciprocal movement of the brush 110, more frost is taken off during the first movement. Accordingly, by first moving the brush 110 from top to bottom, it is possible to prevent the removed frost from being scattered to the periphery and efficiently collect the frost.

Also, in the present embodiment, as shown in FIG. 1, a frost drip pan 130 is provided under the fin 104 on the upstream side. With this configuration, as described above, the frost crystals 120 removed by moving the brush 110 accumulate on the frost drip pan 130. Accordingly, it is possible to appropriately collect the removed frost crystals 120, and reduce the burden of cleaning the area around the fin 104. Because the standby-position of the brush 110 is set to a top portion of the fin 104, the brush 110 does not absorb water from the frost drip pan 130.

In the present embodiment, a brush is used as an example of the mechanical removal means, but the mechanical removal means is not limited thereto. Other examples of the mechanical removal means may include the use of a scraper besides a brush, and the application of vibration or impact to the fin. Also, the shape of the brush is not necessarily limited to a fan shape, and a brush having any other shape can be used. Furthermore, the operation of the brush is not limited to that described above. The frost crystals 120 may be removed with the brush being rotated. In other words, it is also possible to use a rotary brush.

When the air passes through the heat exchanger 100, on the upstream side (primary side), cooling and condensation occur, and frost is formed, which is further cooled inside the heat exchanger 100, and thus on the downstream side (secondary side), the air is dry. Since frost is formed primarily on the upstream side, it is sufficient that the brush 110 is provided only on the upstream side. In addition, by providing the brush 110 only on one side, the apparatus configuration can be simplified.

However, as the crystals grow, the orientation is disrupted, and each thin sheet of frost crystals 120 becomes thick and eventually bonds to adjacent thin sheets. If such a situation happens, the thin sheet layers supplement each other, increasing the rigidity, and making it difficult for the brush 110 to remove the thin sheets. For this reason, it is preferable to run the brush 110 at a certain frequency according to the speed of growth of the frost crystals 120.

Furthermore, in the first embodiment, as shown in FIG. 2, the protruding portions 106 are also formed, in addition to on the upstream-side edge 104*a* of the fin 104, in the vicinity of an edge 104*b* of the fin 104 (heat transfer member), the edge 104*b* being on the downstream side in the air traveling direction. With this configuration, on the downstream side of the fin 104 as well, the moisture in the air is crystallized on the protruding portions 106. Accordingly, it is possible to absorb, from the air, heat of solidification that occurs when the moisture is crystallized.

Figure 6A:
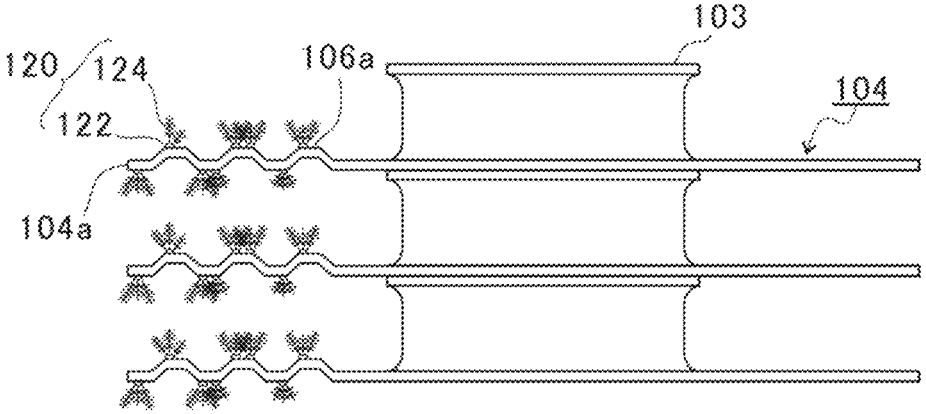
FIG. 6(*a*) and FIG. 6(*b*) show diagrams illustrating formation and removal of the frost crystals 120.
Figure 6B:
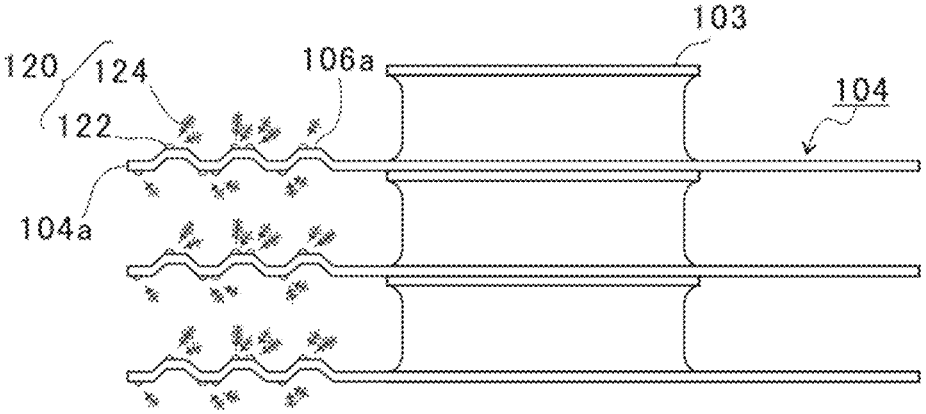

FIG. 6(*a*) and FIG. 6(*b*) show diagrams illustrating formation and removal of the frost crystals 120. FIG. 6(*a*) is a diagram schematically showing the fin 104 on which the frost crystals 120 are formed, and FIG. 6(*b*) is a diagram schematically showing the fin 104 after removal of the frost crystals 120. When droplets adhere to the flat surface portions 106*a*, as shown in FIG. 6(*a*), seed crystals 122 are formed on the flat surface portions 106*a*. Then, branch crystals 124 grow on the seed crystals 122, as a result of which the above-described frost crystals 120 are formed.

Then, when a removal operation is performed by using the brush 110 in the manner as described above, as shown in FIG. 6(*b*), the branch crystals 124 are removed, and only the seed crystals remain on the flat surface portions 106*a*. As a result, on the remaining seed crystals 122, branch crystals 124 grow from the seed crystals 122. That is, the seed crystals 122 remain on the flat surface portions 106*a* after removal of the frost crystals 120, and it is therefore possible to facilitate the formation of branch crystals 124. It is thereby possible to efficiently absorb, from the air, heat of solidification that occurs when the moisture is crystallized.

Figure 7A:
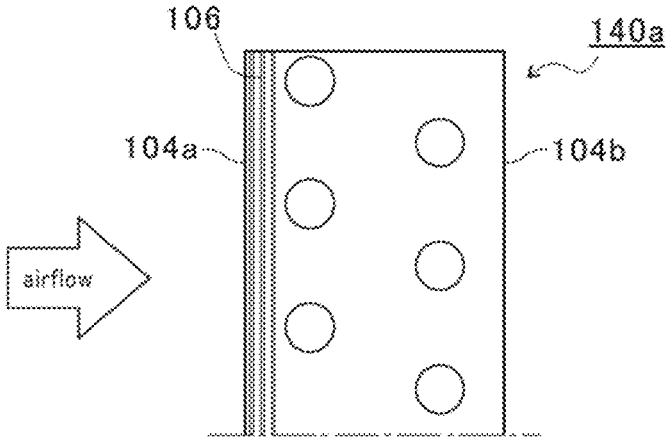
FIG. 7(*a*), FIG. 7(*b*), and FIG. 7(*c*) show diagrams illustrating some variations of the heat exchanger 100 according to the first embodiment.
Figure 7B:
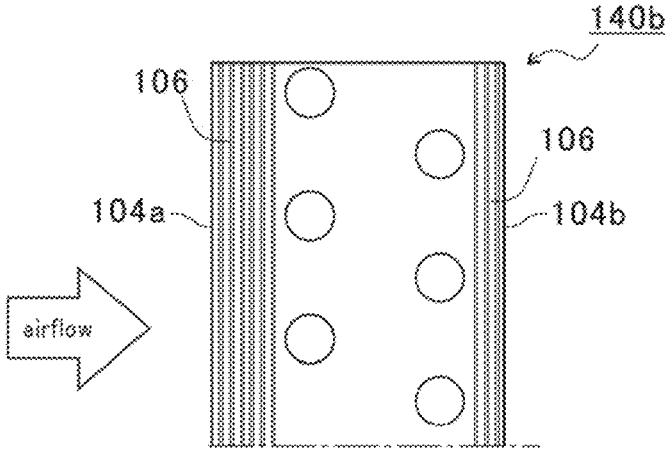
Figure 7C:
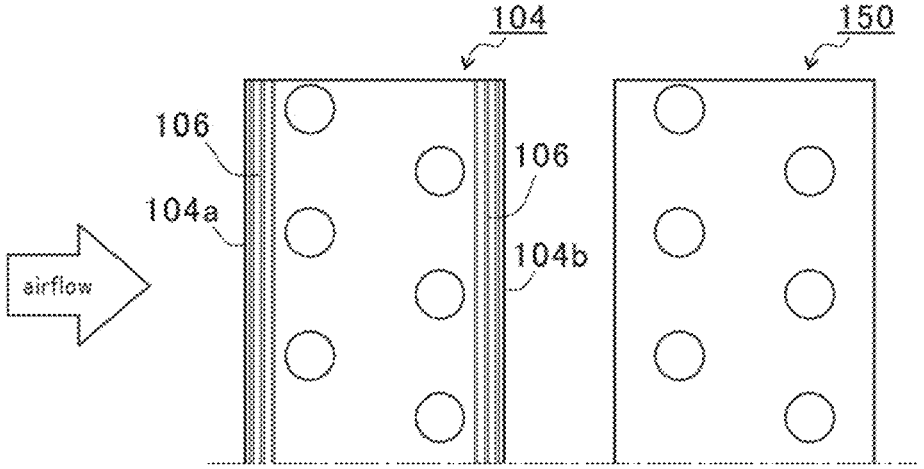

FIG. 7(*a*), FIG. 7(*b*), and FIG. 7(*c*) show diagrams illustrating some variations of the heat exchanger 100 according to the first embodiment. The fin 104 shown in FIG. 2 is configured such that the protruding portions 106 are formed in the vicinity of both the upstream-side edge 104*a* and the downstream-side edge 104*b*. In contrast, a fin 140*a* shown in FIG. 7(*a*) is configured such that the protruding portions 106 are formed only in the vicinity of the upstream-side edge 104*a*. When a flow of air passes through the heat exchanger 100, a large proportion of moisture in the flow of air is deposited as frost crystals on the protruding portions 106 in the vicinity of the upstream-side edge 104*a*. Accordingly, even with a configuration as shown in FIG. 7(*a*) in which the protruding portions 106 are provided only in the vicinity of the upstream-side edge 104*a* of the fin 140*a*, it is possible to sufficiently obtain the above-described effects.

A fin 140*b* shown in FIG. 7(*b*) is configured such that the protruding portions 106 are formed in the vicinity of both the upstream-side edge 104*a* and the downstream-side edge 104*b*, with a greater number of protruding portions 106 being provided on the upstream side than on the downstream side. With this configuration, on the upstream side, the protruding portions 106 can absorb heat from the air, and on the downstream side, the moisture remaining in the air that has passed through the upstream side is further crystallized. By providing more protruding portions 106 on the upstream side where most of the moisture in the air is crystallized, it is possible to facilitate the crystallization of moisture and efficiently absorb heat of solidification.

In FIG. 7(*c*), on the downstream side of the fin 104 that is a heat transfer member, a downstream fin 150 that is a downstream heat transfer member is disposed so as to be spaced apart from the fin 104. In the downstream fin 150, because dry air flows therethrough, the amount of frost formed is very small, and thus the reduction in heat transfer coefficient is small. Accordingly, it is possible to more efficiently perform heat exchange with air.

Figure 8A:
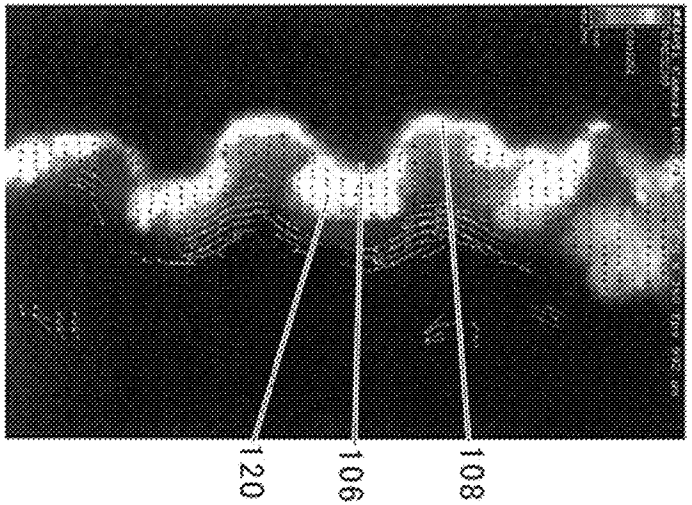
FIG. 8(*a*) and FIG. 8(*b*) show diagrams illustrating the result of test under a natural convection of the heat exchanger 100 according to the first embodiment.
Figure 8B:
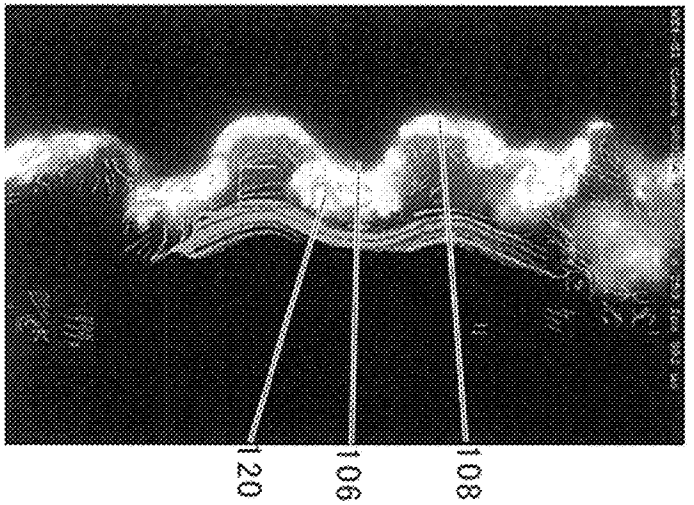

FIG. 8(*a*) and FIG. 8(*b*) show diagrams illustrating the result of test under a natural convection of the heat exchanger 100 according to the first embodiment. In the test under a natural convection, an experiment sample was made by adhesively attaching the fin 104 of the heat exchanger according to the first embodiment to a vertical cooling surface. Experiment conditions were set as follows: a surface temperature of the cooling surface of about −120° C.; a temperature of the surrounding environment of 21000° C.; and a humidity of 0.012 kg/kg. As tracer particles, ice particles formed in the boundary layer were used.

As shown in FIG. 8(*a*), it can be seen that, in the fin 104, frost crystals 120 are formed on the protruding portions 106 of the fin 104, but not in the recess portions 108. As described above, by providing protruding portions 106 on an edge of the fin 104, it is possible to selectively form frost crystals on the protruding portions 106 rather than on the entire fin 104. With this configuration, it is possible to prevent the reduction in the heat transfer coefficient of the recess portions and appropriately remove the frost crystals 120 by using the brush 110.

FIG. 8(*b*) shows a flow of tracer particles in the vicinity of the protruding portions 106 of the fin 104. As shown in FIG. 8(*b*), in the vicinity of the protruding portions 106 of the fin 104, air flows along the apexes of the plurality of protruding portions 106. At this time, a portion of the air flows into the recess portions 108, generating a vortex in the recess portions 108. Then, in the recess portions 108, heat exchange is performed between the vortex-like air flow and the fin 104, and it is thereby possible to improve the heat exchange efficiency of the fin 104.

Figures 9A, 9B:
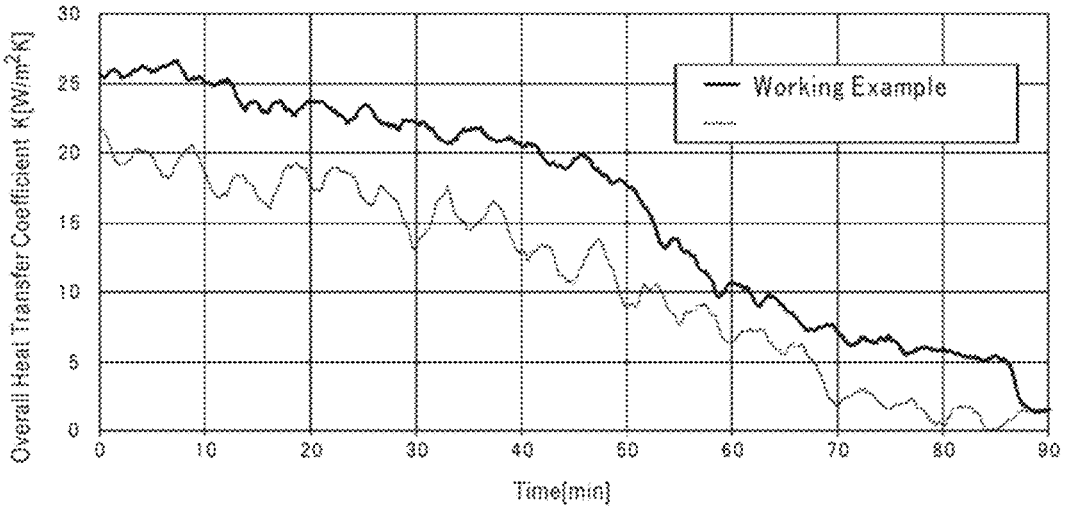
FIG. 9(*a*) and FIG. 9(*b*) show diagrams illustrating the result of test under a forced convection of the heat exchanger 100 according to the first embodiment.

FIG. 9(*a*) and FIG. 9(*b*) show diagrams illustrating the result of test under a forced convection of the heat exchanger 100 according to the first embodiment. FIG. 9(*a*) is a graph showing changes in overall heat transfer coefficient in a working example and a comparative example. FIG. 9(*b*) is a diagram showing the values of heat exchange efficiency in the working example and the comparative example. In the working example, the heat exchanger 100 according to the first embodiment (the heat exchanger 100 including the fin 104 provided with protruding portions 106 on its edges) was used. In the comparative example, a heat exchanger including a flat plate-like fin that is not provided with a protruding portion was used. Experiment conditions were set as follows: an air temperature of 2° C.; a humidity of 80%; and a surface wind velocity of 1 m/s.

As shown in FIG. 9(*a*), the working example constantly exhibited a higher value of overall heat transfer coefficient than the comparative example irrespective of the elapsed time. From this, it can be understood that the present invention can produce an effect of improving the heat exchange efficiency with air. It is also clear from FIG. 9(*b*) that a significantly higher heat exchange efficiency is obtained in the working example than in the comparative example irrespective of the elapsed time.

Next, a description will be given of a dimensional relationship between the protruding portions 106 and the recess portions 108 in order to form the frost crystals 120 as described above. To give the conclusion first, the minimum width of the flat surface portions 106*a* is preferably 100 μm or more and 500 μm or less. The minimum width of the spacing (or in other words, the width of a recess portion 108) between the flat surface portions 106*a* of the protruding portions 106 is preferably 100 μm or more and 1000 μm or less. As used herein, "minimum width" refers to a crosswise width of the protruding portions 106 and the recess portions 108, rather than a lengthwise width (the length of a rib or groove) of the same. The protruding portions preferably have a height of 50 μm or more. As used herein, "the height of the protruding portions 106" means, to put it differently, the depth of the recess portions 108.

Figures 10A, 10B:
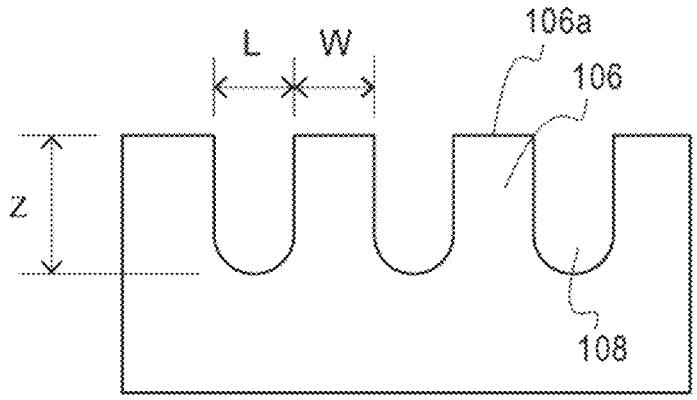
FIG. 10(*a*) and FIG. 10(*b*) show diagrams illustrating an experiment performed to examine the dimensional relationship.

FIG. 10(*a*) and FIG. 10(*b*) show diagrams illustrating an experiment performed to examine the dimensional relationship. In each copper plate test piece, protruding portions 106 and recess portions having the following dimensions were formed by forming six recess portions 108 that are linear grooves by electric discharge processing. As shown in FIG. 10(*a*), the width of the flat surface portions 106*a* is represented by W [μm], the spacing between the flat surface portions 106*a* is represented by L [μm]n, and the height of the protruding portions is represented by Z [μm]. Then, as shown in FIG. 10(*b*), in Working Examples 1 to 3, the width W of the flat surface portions was changed to 100 μm, 250 μm, and 500 μm, respectively while the spacing L between the flat surface portions was fixed to 250 μm. The height Z of the protruding portions was changed from 300 μm to 700 μm by an increment of 100 μm by assigning sub-numbers a to e. In Working Examples 4 to 6, the spacing L between the flat surface portions was changed to 500 μm, 750 μm, and 1000 μm, respectively while the width W of the flat surface portions was fixed to 250 μm and the height Z of the protruding portions was fixed to 700 μm. Also, as a comparative example, the state of frost formed on an unprocessed copper place was observed.

Figure 11A:
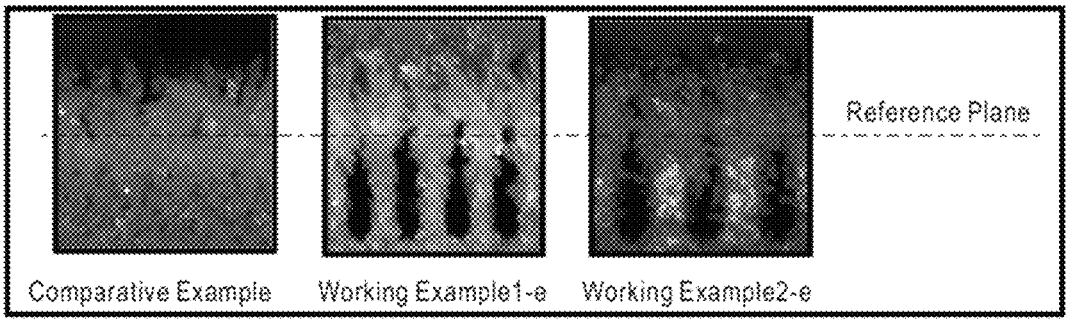
FIG. 11(*a*), FIG. 11(*b*), and FIG. 11(*c*) show microscopic images showing a state of frost formation.
Figure 11B:
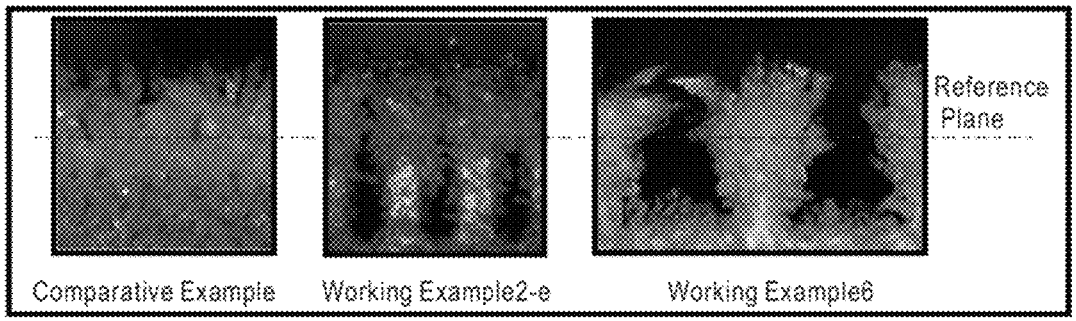
Figure 11C:
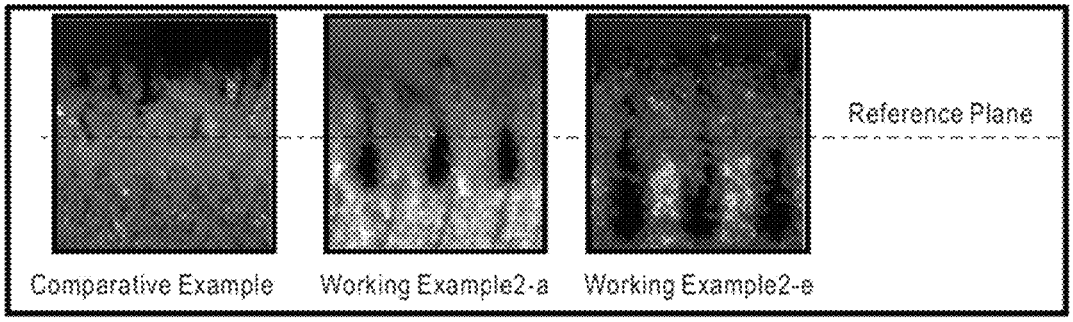

FIG. 11(*a*), FIG. 11(*b*), and FIG. 11(*c*) show microscopic images showing a state of frost formation. The term "reference plane" used in FIG. 11 refers to the flat surface portions 106*a* on top of the protruding portions 106 in the case of the working examples, and the surface of the copper plate in the case of the comparative example. In the frosting experiment shown in FIG. 11, test pieces as shown in FIG. 4 were cooled to −10° C., and then the growth process of frost crystals was captured in the atmosphere.

FIG. 11(*a*) is a diagram for comparison of the width W of the flat surface portions. It can be seen that the reference plane is uniformly frosted in the comparative example. On the other hand, in Working Example 1-e (with a width W of 100 μm) and Working Example 2-e (with a width W of 250 μm), frost was formed on the flat surface portions 106*a* of the protruding portions 106 and the crystals grew in the normal direction, but frost was hardly formed in the recess portions 108. Although not shown in the diagrams, in Working Example 3 (with a width W of 500 μm) as well, frost was formed on the surface of the flat surface portions 106*a* and the crystals grew in the normal direction of the flat surface portions 106*a*. From the above results, it was confirmed that the flat surface portions 106*a* preferably have a width of 100 μm or more and 500 μm or less.

A case will be described where the width W of the flat surface portions is less than 100 μm. The moisture in air adheres to the fin 104 in the form of supercooled liquid droplets. When the supercooled state is released, ice crystals start growing within the droplets. If the width W of the flat surface portions is smaller than the size of the supercooled liquid droplets, spherical droplets adhere to the tip ends of the protruding portions 106, and the crystals grow radially. That is, in order to cause the crystals to grow in the normal direction of the flat surface portions 106*a*, it is necessary to set the width W of the flat surface portions to be larger than the diameter of the supercooled liquid droplets. Another experiment was conducted to find that the size of the supercooled liquid droplets was 72 μm in the case of a hydrophilic treated fin and was 28 μm in the case of a water repellent treated fin. Accordingly, it can be assumed that, taking a certain amount of variation into consideration, when the flat surface portions have a width W of 100 μm or more, it is highly probable that the crystals can grow in the normal direction of the flat surface portions 106*a*.

Consideration is given to a case where the width W of the flat surface portions is greater than 500 μm. In this case, crystals grow in the normal direction, but the interface between the flat surface portions 106*a* and the frost crystals 120 increases (the bottom of the crystals becomes thick), which increases the mechanical strength, as a result of which it becomes difficult to mechanically remove them. Accordingly, the upper limit of the width W of the flat surface portions is set to 500 μm or less because frost was easily removed by the brush 110 described above when the upper limit was within the range, although the upper limit may vary depending on the removal means.

FIG. 11(*b*) is a diagram for comparison of the spacing L between the flat surface portions. In Working Example 2-e (with a spacing L of 250 μm), frost was hardly formed in the recess portions 108, but in Working Example 6 (with a spacing L of 1000 μm), frost was slightly formed in the recess portions 108. Also, as shown in FIG. 5(*a*), in the case of Working Example 1-e (with a spacing L of 100 μm) as well, frost was hardly formed in the recess portions 108.

In the case where the spacing L between the flat surface portions is less than 100 μm, frost is not formed in the recess portions 108. However, thin plates of frost crystals 120 become thicker as the crystals grow, and thus if adjacent thin sheets of frost are too close to each other, they bond to each other in an early stage, resulting in a robust structure. For this reason, it is preferable that the spacing L of the flat surface portions is 100 μm or more.

In the case where the spacing L between the flat surface portions is greater than 1000 μm, more frost is formed in the recess portions 108, and thus the significance of formation of protruding portions and recess portions is lost. In the case where the spacing L between the flat surface portions is 1000 μm as well, frost was observed in the recess portions 108, but it was possible to remove the frost in this state by using the brush 110 described above. From this, it was confirmed that the spacing L between the flat surface portions is preferably 1000 μm or less.

As noted above, the critical significance of the numerical ranges such as the width W of the flat surface portions being in a range of 100 μm or more and 500 μm or less, and the spacing L between the flat surface portions being in a range of 100 μm or more and 1000 μm or less means that it has been confirmed that the present invention can be carried out as long as the ranges described above are satisfied. In other words, it does not mean that the present invention cannot be carried out if the ranges described above are exceeded slightly.

FIG. 11(*c*) is a diagram for comparison of the height Z of the protruding portions. It can be seen that in both Working Example 2-a (with a height Z of 300 μm) and Working Example 2-e (with a height Z of 700 μm), frost was not formed in the recess portions 108, and thus gaps were formed (black portions in the diagram). From this, it was confirmed that when the height Z of the protruding portions is 300 μm or more, frost crystals 120 are formed on the flat surface portions 106*a*. With respect to forming the recess portions 108 in a greater depth, there is almost no thermal limitation, and the height Z is determined by the limitations of the processing technique for forming the recess portions 108.

Figure 12:
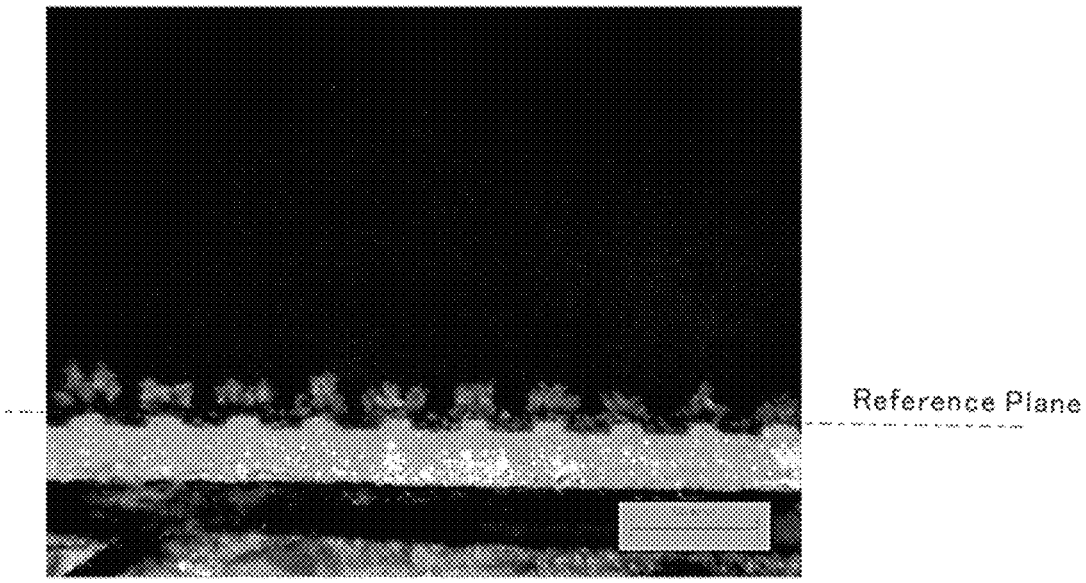
FIG. 12 is a microscopic image showing a state of frost formation in Working Example 7.

FIG. 12 is a microscopic image showing a state of frost formation in Working Example 7. In Working Example 7, a fin was used in which the parameters shown in FIG. 10(*a*) were set as follows: the width W of the flat surface portions=100 μm; the spacing L between the flat surface portions=200 μm; and the height Z of the protruding portions=50 μm. As is clear from FIG. 12, in the case where the height Z of the protruding portions is 50 μm as well, frost crystals are formed on the reference plane, or in other words, the flat surface portions of the protruding portions of the fin. Accordingly, it can be understood that the effects of the present invention can be sufficiently obtained even when the height Z of the protruding portions is 50 μm, which is lower than 300 μm described above.

Figure 13:
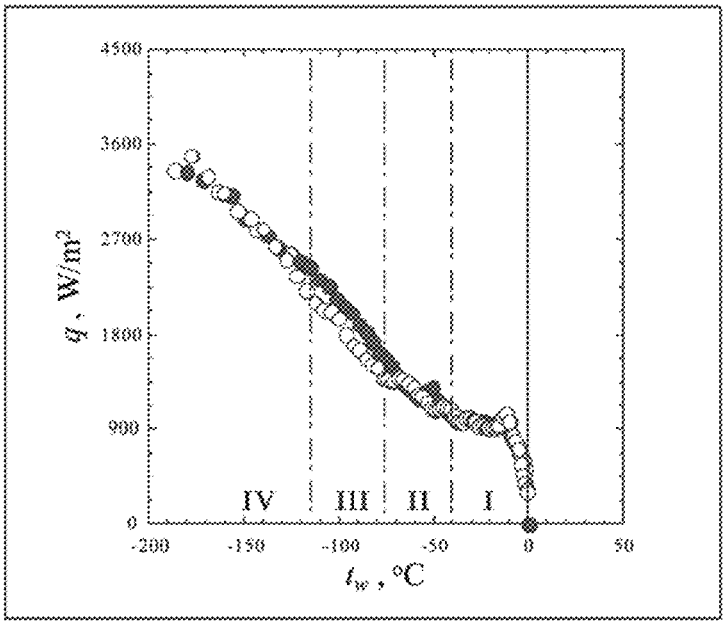
FIG. 13 is a diagram illustrating a heat flux.

FIG. 13 is a diagram illustrating a heat flux. FIG. 13 shows the results of measurement of heat flux in Working Example 2-e and the comparative example shown in FIG. 10. In the graph shown in FIG. 13, the horizontal axis indicates cooling surface temperature [° C.], and the vertical axis indicates heat flux [W/m2]. The initial cooling surface temperature tw0 was set to −190° C., the air temperature 1a was set to 25° C., the cooling surface orientation θ was set to 90 degrees, and the air humidity xa was set to 0.0119 kg/kg.

As shown in FIG. 13, with respect to heat flux, almost no difference was observed between Working Example 2-e and the comparative example that used an unprocessed copper plate. From this, it was confirmed that the performance of the heat exchanger 100 does not decrease even when the protruding portions 106 and the recess portions 108 are formed.

As described above, by providing the protruding portions 106 and the recess portions 108 as described above on the surface of the heat exchanger 100, it is possible to form frost crystals 120 having a comb-like shaped structure in which thin sheets of the frost crystals 120 are provided on the flat surface portions 106*a* that are on top of the protruding portions 106. Such frost crystals 120 are structurally weak and thus can be easily removed by mechanical removal means. Accordingly, it is possible to provide a heat exchanger that can perform a continuous operation for a long period of time while utilizing heat of solidification.

The present invention does not necessarily exclude conventional defrosting by heat (defrosting by reversing the refrigerant in a heat pump or by spraying water), and thus can be used in combination. For example, conventionally, defrosting by heat is performed at a frequency of about every 20 minutes, but when combined with the present invention, by performing defrosting by heat at a frequency of about every hour, it is possible to sufficiently obtain the benefits.

Figure 14A:
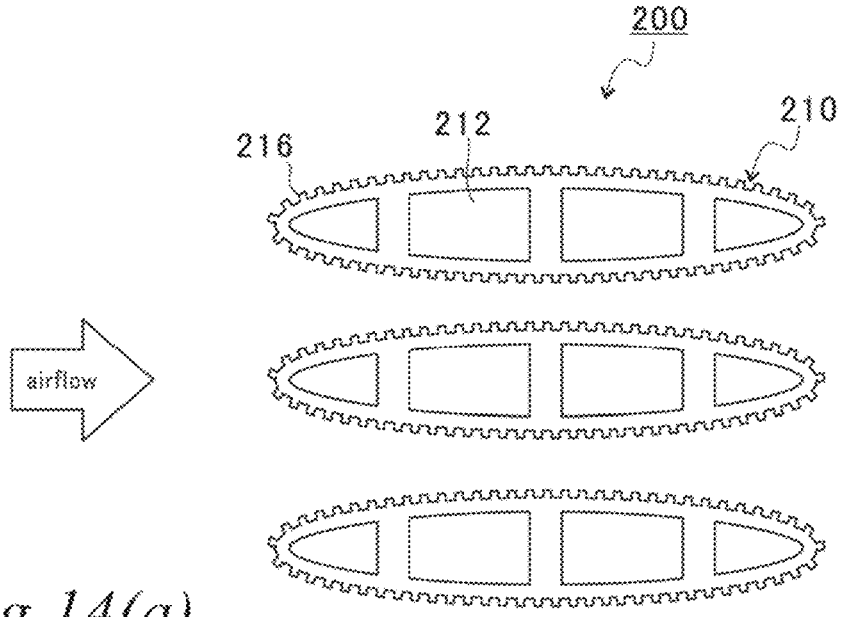
FIG. 14(*a*) and FIG. 14(*b*) show diagrams illustrating a configuration of a heat exchanger according to a second embodiment.
Figure 14B:
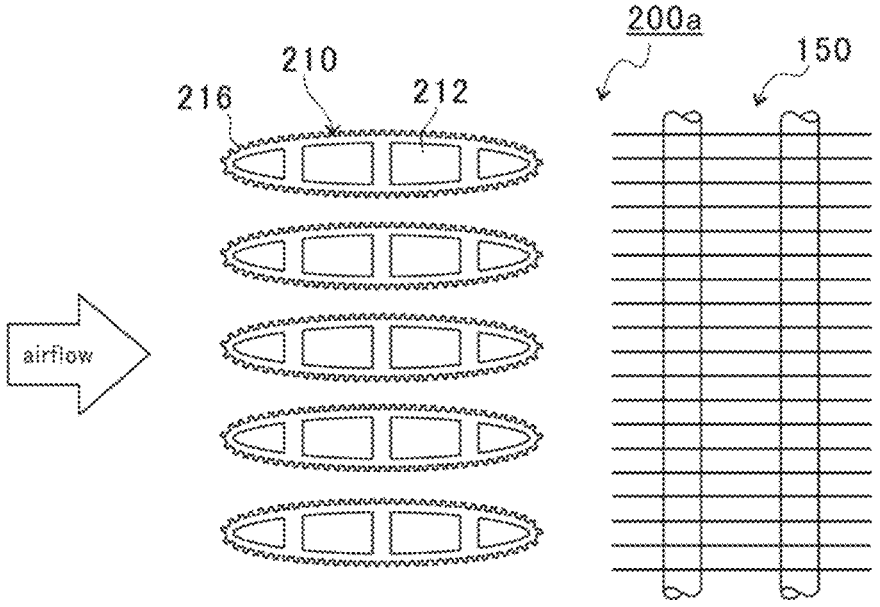

FIG. 14(*a*) and FIG. 14(*b*) show diagrams illustrating a configuration of a heat exchanger 200 according to a second embodiment. As shown in FIG. 14(*a*), the heat exchanger 200 according to the second embodiment includes, instead of the fin 104 of the heat exchanger 100 according to the first embodiment, a finless tube 210 as an example of a heat transfer member. Although FIG. 14(*a*) shows only three finless tubes 210, the heat exchanger 200 includes a large number of finless tubes 210. The finless tubes 210 have refrigerant flow paths 212 through which a refrigerant passes through.

As a feature of the present embodiment, in each finless tube 210, a plurality of linear protruding portions 216 are formed. With this configuration, even with the heat exchanger 200 including the finless tubes 210, instead of the fin 104, as a heat transfer member, the same effects can be obtained.

In each finless tube 210 shown in FIG. 14(*a*), the protruding portions 216 are formed on the entire outer surface, but the present invention is not limited thereto. As long as the protruding portions 216 are formed at least in the outer surface of the finless tube 210 that is on the upstream side in the air traveling direction, the same effects as those of the heat exchanger 100 according to the first embodiment can be obtained.

FIG. 14(*b*) is a variation of the heat exchanger 200 according to the second embodiment. In a heat exchanger 200*a* shown in FIG. 14(*b*), on the downstream side of the finless tubes 210 serving as a heat transfer member, a downstream fin 150 that is an example of a downstream heat transfer member is disposed so as to be spaced apart from the finless tubes 210. In this way, by providing two heat transfer members, it is possible to more efficiently absorb heat from the air.

In FIG. 7(*c*), the fin 104 is shown as an example of a heat transfer member, and the downstream fin 150 is shown as an example of a downstream heat transfer member. In FIG. 14(*b*), the finless tubes 210 are shown as an example of a heat transfer member, and the downstream fin 150 is shown as an example of a downstream heat transfer member. However, the present invention is not limited to the combinations described above. That is, it is possible to select a fin tube and finless tubes as appropriate as the upstream and downstream heat transfer members.

Also, the fin or finless tubes serving as the downstream heat transfer member may be provided with protruding portions 106 on an upstream-side edge thereof. Alternatively, the protruding portions 106 may not be provided. Furthermore, in the present embodiment, a fin and finless tubes are shown as examples of the heat transfer member, but the present invention is not limited thereto, and the present invention is applicable to other heat transfer members.

Preferred embodiments of the present invention have been described above with reference to the accompanying drawings, but the present invention is of course not limited to the examples given above. It is apparent that a person having ordinary skill in the art can conceive various types of modifications and changes within the scope of the appended claims, and such modifications and changes also of course fall within the technical scope of the present invention.

The present invention can be used as a heat exchanger including a heat transfer member that performs heat exchange with air.

INDEX TO THE REFERENCE NUMERALS

100 heat exchanger
102 tube
103 insertion hole
104 fin
104*a* edge
104*b* edge
106 protruding portion
106*a* flat surface portion
108 recess portion
110 brush
110*a* shaft
112 bristle
112*a* upper bristle
112*b* lower bristle
120 frost crystal
122 seed crystal
124 branch crystal
130 frost drip pan
140*a* fin
150 downstream fin
200 heat exchanger
200*a* heat exchanger

210 finless tube

212 refrigerant flow path

216 protruding portion

The previous description of the disclosed aspects is provided to enable any person skilled in the art to make or use the present disclosure. Various modifications to these aspects will be readily apparent to those skilled in the art, and the generic principles defined herein may be applied to other aspects without departing from the spirit or scope of the disclosure.

The invention claimed is:

1. A heat exchanger comprising:

a heat transfer member that performs heat exchange with air;

wherein the heat transfer member is a finned tube composed of a plurality of fins and tube sections; and wherein a fin in the plurality of fins includes, in a vicinity of a corresponding first edge thereof, a first plurality of linear protruding portions formed continuously in parallel to the corresponding first edge, wherein the first plurality of linear protruding portions extend over the length of the fin, wherein the corresponding first edge is located on an upstream side in an air traveling direction and wherein the linear protruding portions are absent from surfaces formed between the tube sections.

2. The heat exchanger according to claim 1, further comprising a second plurality of linear protruding portions formed in a vicinity of a corresponding second edge of the fin, the corresponding second edge being located on a downstream side in the air traveling direction.

3. The heat exchanger according to claim 2, wherein a first number corresponding to a count of the first plurality of protruding portions on the upstream side of the fin exceeds a second number corresponding to a count of the second plurality of protruding portions on the downstream side of the fin.

4. The heat exchanger according to claim 1, further comprising a downstream heat transfer member that is disposed on a downstream side of the heat transfer member so as to be spaced apart from the heat transfer member.

5. The heat exchanger according to claim 1, wherein the first plurality of protruding portions are disposed so that adjacent protruding portions are spaced apart from each other in the air traveling direction;

wherein the first plurality of protruding portions include flat surface portions, each flat surface portion on top of a corresponding protruding portion and having a width of 100 μm or more and 500 μm or less;

wherein a spacing between corresponding adjacent flat surface portions of adjacent protruding portions is 100 μm or more and 1000 μm or less; and wherein the first plurality of protruding portions each have a height of 50 μm or more.

6. The heat exchanger according to claim 1, further comprising a brush that is provided to abut the first plurality of protruding portions, wherein the brush is vertically movable.

7. The heat exchanger according to claim 6, wherein the brush is moved from top to bottom and moved back to the top.

8. The heat exchanger according to claim 6, wherein the brush has a fan shape in which bristles expand vertically toward a bristle tip thereof as viewed in a vertical cross section.

* * * * *